US009045868B2

(12) United States Patent
Farrell

(10) Patent No.: US 9,045,868 B2
(45) Date of Patent: Jun. 2, 2015

(54) METHOD AND APPARATUS FOR STAMPING CONCRETE

(71) Applicant: Grant Eugene Farrell, Puyallup, WA (US)

(72) Inventor: Grant Eugene Farrell, Puyallup, WA (US)

( * ) Notice: Subject to any disclaimer, the term of this patent is extended or adjusted under 35 U.S.C. 154(b) by 93 days.

(21) Appl. No.: 13/737,790

(22) Filed: Jan. 9, 2013

(65) Prior Publication Data

US 2013/0177354 A1 Jul. 11, 2013

Related U.S. Application Data

(60) Provisional application No. 61/585,118, filed on Jan. 10, 2012.

(51) Int. Cl.
*E01C 19/43* (2006.01)

(52) U.S. Cl.
CPC ..... *E01C 19/43* (2013.01)

(58) Field of Classification Search
CPC ..... E01C 23/22; E01C 19/43; E01C 23/088; E01C 23/166; E01C 23/0885
USPC ..... 404/17, 72, 75, 83, 89, 93
See application file for complete search history.

(56) References Cited

U.S. PATENT DOCUMENTS

| | | | | |
|---|---|---|---|---|
| 2,595,142 | A * | 4/1952 | Herck | 264/31 |
| 3,550,673 | A | 12/1970 | Gallagher et al. | |
| 3,910,711 | A | 10/1975 | Moorhead | |
| 4,105,354 | A | 8/1978 | Bowman | |
| 4,131,406 | A | 12/1978 | Fresquez | |
| 4,135,840 | A | 1/1979 | Puccini et al. | |
| 4,231,677 | A | 11/1980 | Roming | |
| D272,037 | S | 1/1984 | Puccini | |
| 4,776,723 | A * | 10/1988 | Brimo | 404/89 |
| 4,828,426 | A | 5/1989 | Hendricks et al. | |
| 4,838,728 | A * | 6/1989 | McKeever | 404/89 |
| 4,993,867 | A | 2/1991 | Usow | |
| 5,215,402 | A * | 6/1993 | Stowell et al. | 404/93 |
| 5,487,526 | A * | 1/1996 | Hupp | 249/2 |
| 5,502,941 | A * | 4/1996 | Zember et al. | 52/314 |
| 5,792,511 | A | 8/1998 | Oliver et al. | |
| 6,360,505 | B1 | 3/2002 | Johns | |
| 6,382,871 | B1 * | 5/2002 | Ross | 404/75 |
| 6,588,975 | B2 * | 7/2003 | Ross | 404/75 |
| 7,066,680 | B2 * | 6/2006 | Wiley | 404/75 |
| 8,119,202 | B2 * | 2/2012 | Wiley | 427/372.2 |
| 8,133,540 | B2 * | 3/2012 | Wiley et al. | 427/372.2 |
| 2002/0076278 | A1 * | 6/2002 | Ross | 404/75 |
| 2003/0103810 | A1 * | 6/2003 | Wiley | 404/75 |
| 2004/0105933 | A1 * | 6/2004 | Wiley | 427/136 |
| 2005/0089372 | A1 * | 4/2005 | Wiley | 404/75 |
| 2005/0097827 | A1 * | 5/2005 | Jordan | 52/21 |
| 2006/0070698 | A1 * | 4/2006 | Wiley | 156/212 |
| 2008/0182016 | A1 * | 7/2008 | Wiley et al. | 427/136 |

* cited by examiner

*Primary Examiner* — Abigail A Risic
(74) *Attorney, Agent, or Firm* — Seed IP Law Group PLLC

(57) ABSTRACT

A molded flexible tool for use in stamping a pattern into a base material, such as concrete, that has integrally formed segments defining openings to form grout lines in the base material. The flexible tool can be folded or rolled for storage and easily and quickly unrolled for deployment, use, and then cleaned and refolded or rolled for storage.

15 Claims, 6 Drawing Sheets

METHOD AND APPARATUS FOR STAMPING CONCRETE

BACKGROUND

1. Technical Field

The present disclosure is directed to surface ornamentation of concrete structures and, more particularly, to a reusable compliant tool and method of applying designs into unfinished concrete.

2. Description of the Related Art

Forming surface ornamentation in concrete is both a skill and an art form that requires proper tools and an appreciation for artistic expression. Numerous methods and tools have been developed to aid in forming a design in base materials like concrete, patios, walkways, and the like.

For example, one approach has been the use of paper stencils to provide guidelines for the worker to use a tool in forming the impression in the concrete. The disadvantage of this approach is that the paper can only be used once, is difficult to work with in the wind, and can sometimes leave artifacts in the concrete. In addition, this approach is limited to relatively small-scale impressions. Larger impressions require using multiple copies of the paper stencil, resulting in increased costs in labor and time, and a low quality in the final product. Hence, paper-based impression patterns are disfavored.

Concrete stamping with tools is a labor-intensive process that involves using a stamp pad having a working face with a desired impression to be transferred into the concrete. This can include three-dimensional textures as well as two-dimensional graphic designs. Such tools usually require multiple stamp pads to avoid repeated duplication of the pattern, unless such duplication is desired. In addition, before the tool can be laid down, the stamp pad must be treated with a release agent so that it is easily removable from the concrete after the impression is formed. Thus, after the release agent is applied, the stamp pad is laid down and pounded into the concrete, and then the concrete finisher must attempt to place the next stamp pad adjacent the first stamp pad to have a pattern in the correct format. The stamping process is then repeated.

Tools used in this regard are illustrated and described in a number of prior patents, which are summarized below.

Moorhead (U.S. Pat. No. 3,910,711) describes a concrete or paving forming apparatus and process that includes allowing a concrete or paving material to cure into a substantially plastic condition and then imprinting it with a pattern impressed therein in a continuous process. A plastic film or other suitable release agent permits the forming apparatus to be driven into the concrete in a manner whereby it will not remove the surface of the concrete when it is withdrawn.

The apparatus generally includes a roller with a series of patterns formed by means of blades that conform to the pattern that is to be pressed into the concrete. The roller effectively rolls in the pattern while at the same time a sheet of plastic film is laid down on the concrete ahead of the roller. Thus, as the roller is impressed into the concrete and removed, it will not gouge the concrete. Other release agents such as the silicones or the tetrafluorethylenes can be sprayed on the roller blades or on the concrete to prevent binding and gouging of the pavement.

Moorhead does not indicate what material is used to construct the roller other than it is a "non-deformable material." Moorhead does indicate a release agent such as a spray or a plastic sheet be laid down between the roller and the concrete to act as a buffer, implying that it did not occur to Moorhead to make a molded polyurea or polyurethane concrete stamp.

Bowman (U.S. Pat. No. 4,105,354) describes a squirrel-cage like pattern forming roller for uncured concrete surfaces. A worker ballasted, propelled, and guided roller cage for imprinting predetermined surface patterns upon a slab of freshly cast, smoothed, yet still plastic concrete is illustrated and described. The wheel includes a generally cylindrical frame that is large enough to accommodate a worker in a walking position there within. The frame supports a plurality of rigid blades carried about the outside thereof, the blades configured to provide the patterns desired. A walkway is provided on the inside of the frame for the worker, and the frame may also be gripped by the worker as a handle, if desired. The weight of the worker is combined with the weight of the wheel to aid in driving the blades into the surface of the slab to a predetermined depth. The walkway enables the worker, by a walking movement in a forward direction, to propel the wheel over a path of the slab directed by the worker thereby forming the predetermined surface pattern therein. A plurality of tools of the same diameter may be peripherally linked together to increase simultaneous pattern imprinting width so that the combination of peripherally linked tools will span the width of larger slabs being poured.

Bowman states that the grid pattern on the cylindrical wheel can be formed of "rigid metallic or hard plastic material," including a "very hard elastomeric material, such as a hard rubber, having a durometer hardness of, e.g., 100."

Fresquez (U.S. Pat. No. 4,131,406) describes tools for making impressions in hardenable materials. More specifically, a tool is provided that incorporates a plurality of penetrating blades arranged in a stamping plane. The blades are secured to a platform grid. The blades parallel an edge of the platform to form a closed end of the tool. The blades taper from the platform attached portion to a penetrating tip to thereby form a tapering transverse profile. Blades terminating opposite the closed end of the tool include a mating blade face having a longitudinal profile complimentary to the transverse profile so that when the tool is positioned against other similar tools in making impressions, the closed end-to-open end interface is made without gaps or voids, thereby eliminating hand work in the finishing operation.

Puccini et al. (U.S. Pat. No. 4,135,840) provides tools for imprinting non-repeating stone patterns in fresh concrete. The tool has a plurality of blades forming a non-repeating stone pattern. The perimeter of all interior stone patterns is closed or defined, while all exterior patterns are open and only partially defined. The open blade ends of the open patterns are equally spaced about the perimeter of the tool, so that it will align with an adjacent open blade end of a second tool or an imprint and complete a stone pattern in any position and create a non-repeating design. The tool may also be used to create a random repeating pattern by successive non-rotational alignment of all open blade end of any particular side.

Roming (U.S. Pat. No. 4,231,677) describes a process and apparatus for forming concrete. A lightweight embossing tool is shown and described that provides for patterning an impressionable surface material, for example freshly poured concrete. It includes a one-man rectangular weight-supporting platform having essentially flat top, bottom and side portions, a centrally located opening formed on the top surface of the platform adapted to receive a shaft, the bottom surface of the platform having rigidly connected thereto a plurality of blades arranged within the perimeter of the platform bottom in a predetermined pattern. The design of the tool is such that the weight of a man standing on both feet on the platform and straddling the centrally located opening is substantially evenly distributed along the blades. Roming teaches that the tool should be formed of "any durable cast aluminum allow."

Hendricks et al. (U.S. Pat. No. 4,828,426) shows a device for manually, repetitively imprinting a surface pattern in fresh concrete. The device is described to include a plurality of blades secured together to form an imprinting unit, with lower edges thereof to form the desired pattern when pressed into the leveled surface of fresh concrete. A bar handle is secured transversely to upper portions of the blades to extend laterally beyond the perimeter of the imprinting unit to facilitate manual operation of the device; and a leveling device is secured to and cooperates with the handle to vertically position the blades of the device with respect to the surface to be imprinted. Hendricks et al. describe the blades as "preferably made of metal such as aluminum."

Usow (U.S. Pat. No. 4,993,867) describes a rigid concrete stamping tool with flat handles. More specifically, the concrete stamping tool has a lower blade assembly molded to a substantially flat upper assembly having flat handles on an upper surface thereof. A handle mount is provided in the center of the tool, and an array of holes allows ganging of a plurality of such tools in either the vertical or horizontal direction. The device or tool is described as "rigid" and made of "high impact plastic."

Oliver et al. (U.S. Pat. No. 5,792,511) is directed to a grid and method for producing a pattern on a surface. The grid includes elongated members connected together at intersections and extending about a plurality of open areas to form a mesh-like structure. Connecting members are connected to the elongated members at the intersections. The connecting members extend outwardly from at least one said elongated member. The connecting members have a thickness less than the thickness of the elongated members. The bottoms of the connecting members and bottoms of the elongated members are flush. The grid is placed on a surface and a liquid coating is spread over the surface in the open areas between the elongated members. The liquid coating is allowed to set. Preferably there is a removable coating on the grid which is removed after the liquid coating is set.

Oliver et al. describe the grid as being constructed from concrete with a polymer additive.

Johns (U.S. Pat. No. 6,360,505) describes a surface panel and associated ICF system for creating decorative and utilitarian surfaces on concrete structures. More specifically, the surface panel is designed to allow motif surfaces of brick, stone, tile or siding to be applied to the exterior and interior of concrete structures. The surface panel can be used with other surface panels, or alternatively, as a component of an insulating concrete form (ICF) system. When used with an ICF system, the exterior surface of a concrete structure has a motif surface of brick, stone, tile or siding, while the interior of the structure has an insulating polystyrene surface. Johns states that the panel is made from light weight and durable polystyrene, a rigid material. Alternative materials include plywood.

Puccini (Des. 272,037) shows a tool for imprinting fish scale patterns in fresh concrete. The pattern shown is a curved array, but the grid pattern appears to be made of rigid material.

BRIEF SUMMARY

The present disclosure is directed to a method of forming and applying a reusable flexible tool to uncured concrete in order to form a decorative impression in the concrete. More specifically, the present method and system provides for a reusable tool in the form of a molded polyurea or polyurethane tool or "mold" that can be applied early in the concrete forming process, i.e., when the concrete surface is less cured or set and is more easily formed into the desired impression. Ideally, the mold is formed of cured polyurea.

After forming of the concrete, the mold is then impressed into the concrete to transfer the mold pattern to the concrete surface. Because the molded stamp or die can be formed, transported, and used on a much larger scale than prior concrete design forming tools, and because the design can be transferred to the concrete much faster and with less labor, it has superior benefits over a paper stencil. In addition, the molded, flexible stamp can easily be cleaned, stored, transported, and reused.

As an example, a brick wall or a slate path can be impressed using the disclosed tool. A large, grid-like embodiment of the tool of the invention is applied to a concrete surface to provide the grout lines. One embodiment uses a particular mold pattern, which is a 6' cobblestone circle. This impression has the appearance of a web with only the grout lines visible. When this impression is applied on top of a wet concrete slab, trawled in, and then removed, only the grout line pattern is transferred into the cement. The size ranges are unlimited. It is expected that typical sizes will be used for different projects such as driveways or patios, although any size and any pattern can be designed and used as the molded tool.

In accordance with one embodiment of the present disclosure, an apparatus or tool for forming the impression in the concrete is provided. The apparatus includes a tool for forming impressions in a base material, the tool having a shaped, flexible framework of cured material with integrally formed segments in the shape of a repeatable pattern, the cured material having a memory property to retain and return to an original state such that the framework can be folded multiple times, rolled, and then unfolded or unrolled to return to the original state, the framework configured to be pressed into the base material to leave an impression in the base material in the shape of the repeatable pattern.

In accordance with another aspect of the present disclosure, the foregoing apparatus has the segments formed to have a first side shaped to form an impression in the base material, and an opposing side that comprises a planar surface.

In accordance with another aspect of the present disclosure, each segment of the framework has a first side shaped to form an impression in the base material and an opposing side comprising a planar surface.

In accordance with another aspect of the present disclosure, each segment has a cross-sectional configuration that is one of either a triangle, truncated triangle, or hemispherical.

As will be readily appreciated from the foregoing, the present disclosure provides a method and tool that reduces time, labor, and costs while increasing the quality of the final product. The product is reusable, which will cut down on contractor costs to do decorative concrete projects. The product and the procedure will make decorative concrete more affordable and hence more desirable to the consumer. In addition, the impression to the concrete can be made at a much earlier time in the setting process of the concrete and on a much larger scale with a better quality finished product. By applying the concrete impression at an earlier stage, a concrete finisher is able to finish a larger area of concrete in a shorter amount of time.

BRIEF DESCRIPTION OF THE SEVERAL VIEWS OF THE DRAWINGS

The foregoing and other features and advantages of the present disclosure will be more readily appreciated as the same become better understood from the following detailed description when taken in conjunction with the accompanying drawings, wherein.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures or components or both associated with molded parts, including but not limited to molds and mold forming tools, have not been shown or described in order to avoid unnecessarily obscuring descriptions of the embodiments.

Unless the context requires otherwise, throughout the specification and claims that follow, the word "comprise" and variations thereof, such as "comprises" and "comprising" are to be construed in an open inclusive sense, that is, as "including, but not limited to." The foregoing applies equally to the words "including" and "having."

Reference throughout this description to "one embodiment" or "an embodiment" means that a particular feature, structure, or characteristic described in connection with the embodiment is included in at least one embodiment. Thus, the appearance of the phrases "in one embodiment" or "in an embodiment" in various places throughout the specification are not necessarily all referring to the same embodiment. Furthermore, the particular features, structures, or characteristics may be combined in any suitable manner in one or more embodiments.

Figure 1:
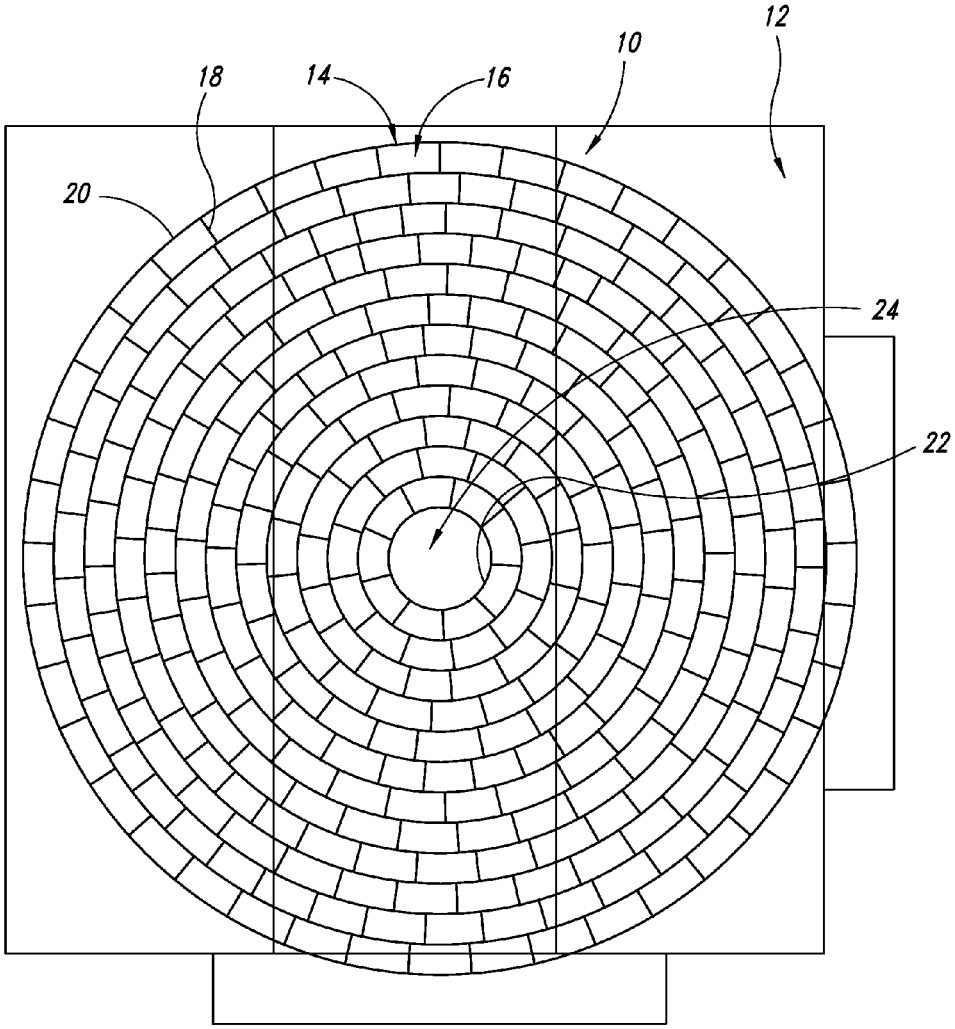
FIG. 1 is a top plan illustration of a molded tool for stamping concrete positioned on top of a concrete pad.

Referring initially to FIG. 1, shown therein is a top plan view of a stamping tool 10 formed in accordance with the present disclosure positioned on top of an existing concrete patio 12. Ideally the tool is designed for forming impressions in a base material, such as concrete that is still wet. The tool preferably has a shaped, flexible framework of cured material with integrally formed segments in the shape of a repeatable pattern. The cured material has a memory property to retain and return to an original state such that the framework can be folded multiple times, rolled, and then unfolded or unrolled to return to the original state. The framework is configured to be pressed into the base material to leave an impression in the base material in the shape of the repeatable pattern.

The particular design shown in FIG. 1 is only one of many ornamental designs or patterns that can be implemented with the tool of the present disclosure. Here, the design is a latticework of segments integrally formed together to create integral segments 14 that define open spaces 16 throughout. In the design of FIG. 1, the segments 14 are arranged in radial segments 18 and concentric arcuate segments 20 that define concentric circles of reducing diameter down to the innermost ring 22 that circumscribes an open circular center space 24.

Figure 6:
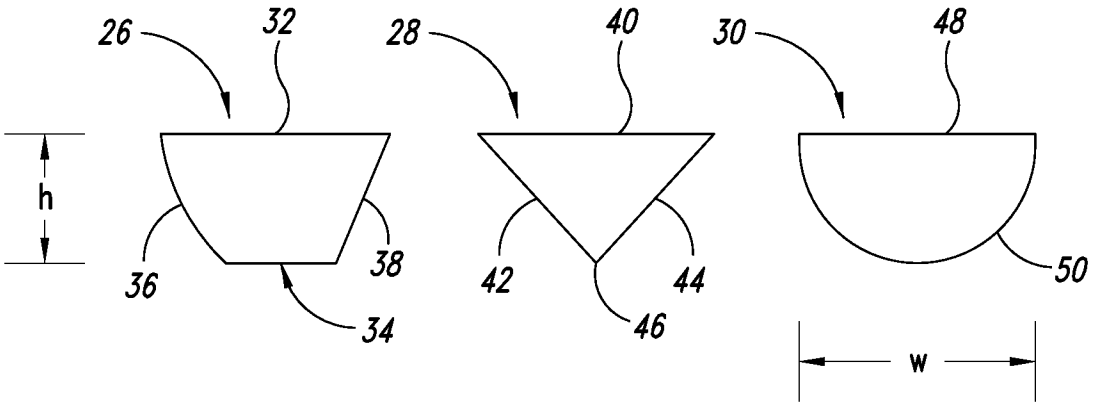
FIG. 6 are three cross-sectional views of segments of the tool formed in accordance with the present invention showing three different geometric cross-sectional configurations.

Each of the segments 18, 20, is formed to have substantially the same cross-sectional shape. FIG. 6 illustrates three representative cross-sectional shapes for the segments. The first shape on the left is a trapezoid 26 having parallel top and bottom surfaces 32, 34 and side surfaces 36, 38 that converge toward the bottom surface 34. The center image is an inverted triangle 28 that has a substantially flat top surface 40 and sides 42, 44 that converge toward and meet at an apex 46. On the right is a half-circle 30 having a substantially flat top surface 48 and an arcuate sidewall 50. In use, the top surface 32, 40, 48 of each of the designs is used for impressing the segment 26, 28, 30 into wet concrete or other curable base material. The impression can be as deep as the height of the segments 26, 28, 30, or anything less.

It is to be understood that the height of the segments h and the width w is generally not limited except by the physical limitations of the materials being used, including the base material. Hence, the present disclosure is not intended to be limited to any particular dimension. Another size limitation is that large segments that have too great of a height could cut too deep into the concrete, fracturing the concrete. However, in the interest of full disclosure, the height h is generally in the range of ½ to ⅜ inch deep. The width w can generally be within the same range, with ¼ inch to be the minimum and the maximum should be no larger than necessary to avoid running into other segments.

The integral segments 18, 20 are preferably formed using a standard molding process. Ideally, the preferred material is a 95 Shore A polyurethane elastomer. When cured, this material has been found to provide the best combination of properties for the intended use of the tool, which is stamping a base material, such as concrete.

When using the polyurethane material, it is provided in two parts, part A, a hardener, and part B, a compound, that react together to activate the material to enable it to cure. Ideally a low-pressure gear proportioner computerized pump is used to control the parts to be mixed at a 1:1 ratio.

The mold for the tool is formed using conventional materials, such as plastic, wood, metal, and the like. The mold is generally lined with a release agent before the polyurethane elastomer material is poured in the mold. Generally the mold is kept at a temperature of 60° to 90°, or about room temperature. After the material is poured into the mold and ideally up to the top of the grout line, it is allowed to sit at room temperature for about 18 to 24 hours, and more preferably 24 hours, before it has usable strength, and up to 5 to 7 days at room temperature in order to have full strength. If the environment is heated, curing is sped up.

After the tool is released from the mold, it should be laid down flat for storage. However, it can be stored in a folded or rolled-up condition, but in that case it should preferably be left out for 1 hour on a planar surface in order to flatten and provide good handling characteristics in use.

The use of the polyurethane elastomer or the polyurea material allows the molded tool to be folded in halves or quarters, or to be tightly rolled, while still retaining its shape when it is unfolded or unrolled. In other words, the material has a "memory" that keeps the segments in their proper orientation and alignment when deployed for use after storage. Ideally the polyurethane elastomer or ployurea is of the highest Shore strength available.

The method of the present disclosure utilizes the tool 10 previously described. Although the representative embodiment is described in the context of a concrete patio, it is to be understood that the tool may be used with any horizontal or vertical base material, including concrete and the like.

With respect to a concrete patio, after the concrete is poured it is floated after tamping and then allowed to partially cure to a firmness that supports the weight of the tool 10. The tool can be unrolled or unfolded onto the concrete, where it is preferably pressed into the concrete with a trowel. Prior to deployment, the tool 10 can be treated with a powder or liquid release agent if desired.

In application, the tool 10 is troweled into the concrete or pressed in using a roller or paint roller, following which the tool is troweled over to smooth out any marks left by the roller or applicator. In addition, a textured mat can be applied over the tool and impressed into the concrete with pressure, such as a tamping tool, to provide a texture to the segments between the grout lines. For larger applications, the tool 10 can be deployed and impressed into the concrete using poles, kneepads, and the like.

Figure 2:
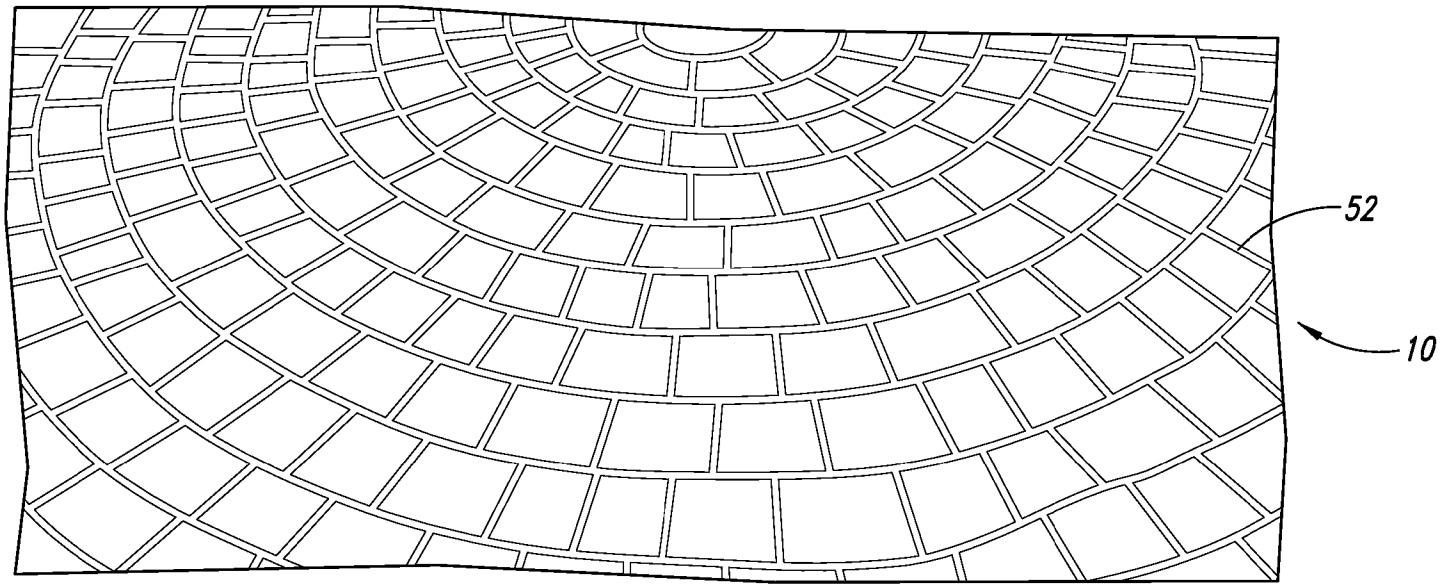
FIG. 2 is an isometric view of the tool of FIG. 1 positioned on uncured concrete.
Figure 3:
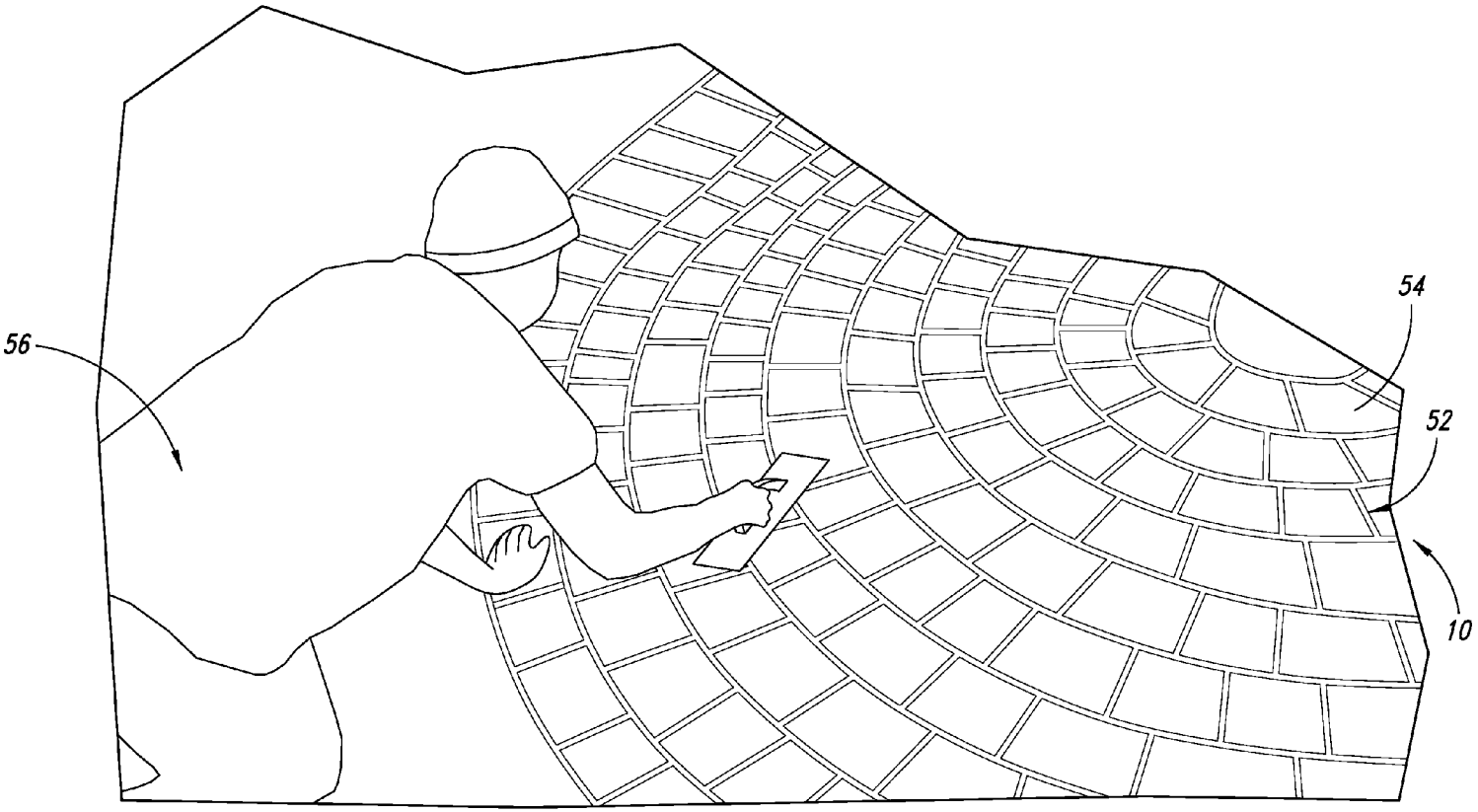
FIG. 3 is an isometric view of the tool of FIG. 2 being pressed into the concrete with a trowel.
Figure 4:
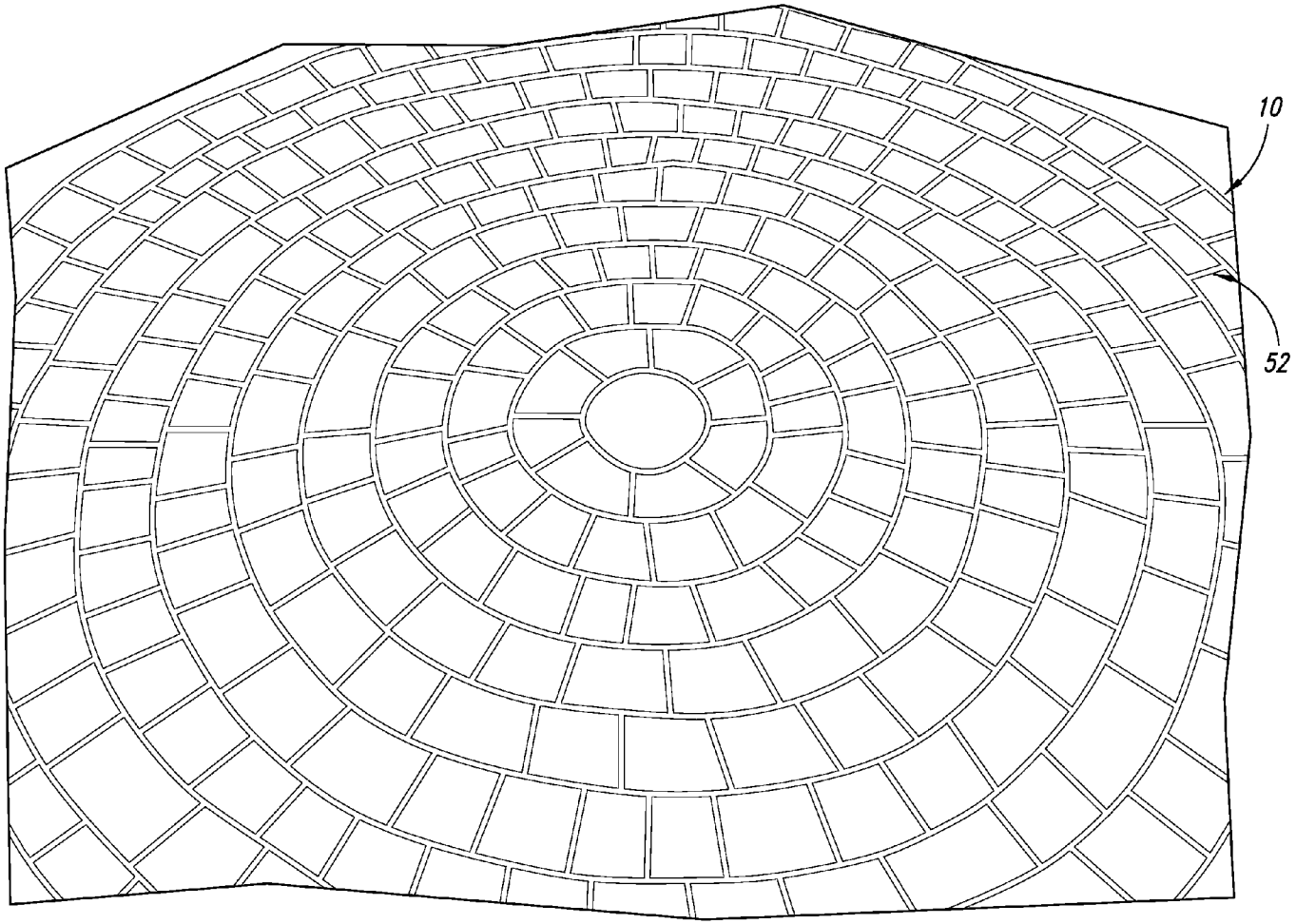
FIG. 4 is an isometric view of the impression of the tool of FIG. 3 remaining in the concrete immediately after removal of the tool.
Figure 5:
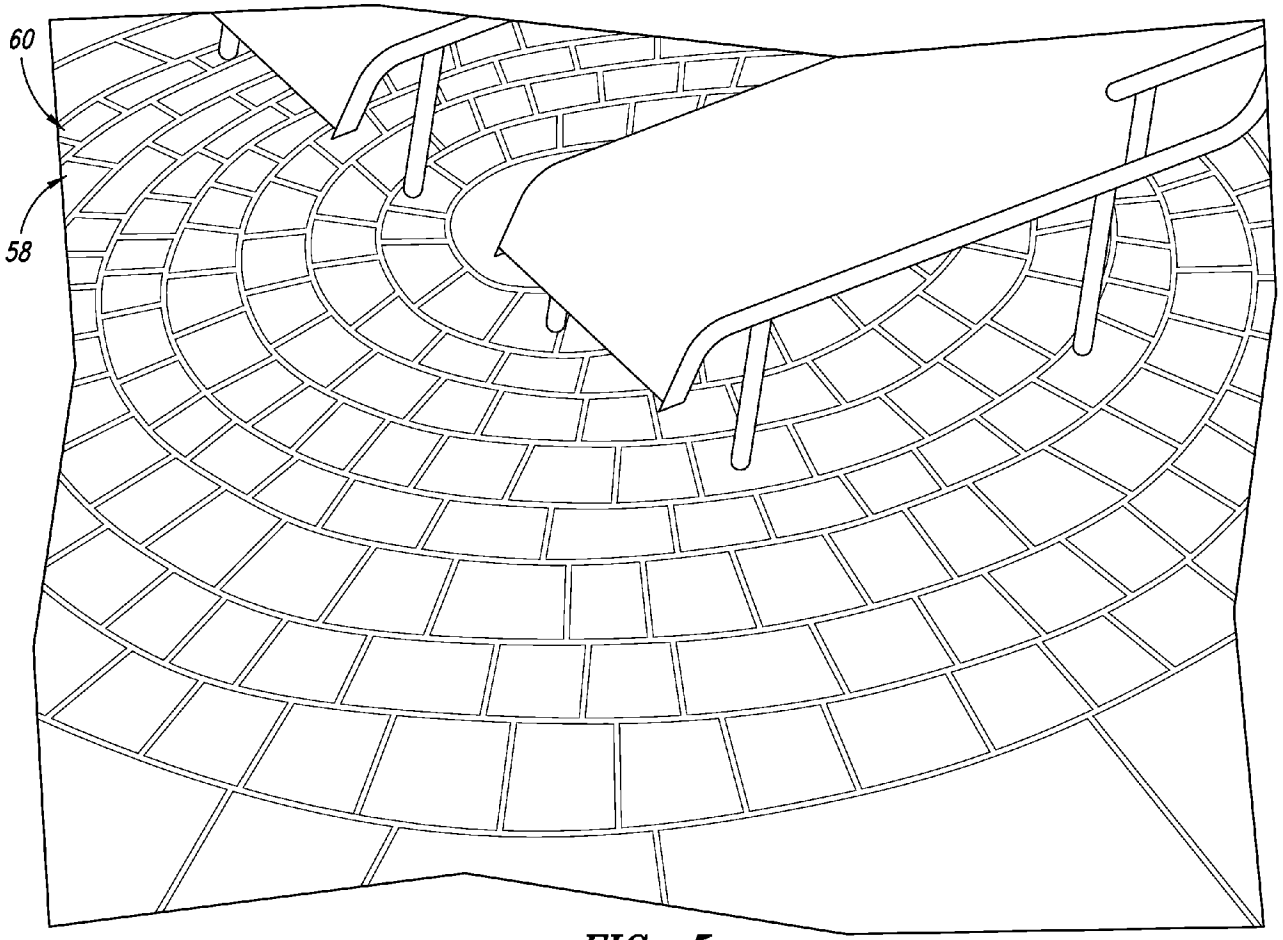
FIG. 5 is an isometric view of the impression in the concrete after curing.

Thus, FIG. 2 shows the tool 10 deployed onto an unfinished concrete pad 52 where it is troweled into place with a trowel 54 by a concrete finisher 56 as shown in FIG. 3. FIG. 4 shows the fully impressed design in the concrete 52 immediately after removal of the tool 10. In FIG. 5, the concrete is cured and the design formed by the grout lines 58 is visible with patio furniture placed on top.

After use, the tool should be washed and cleaned, preferably with water and soap. Because of its construction and material, cleaning is relatively simple. After the tool is cleaned, it can be folded, rolled, or otherwise compacted for storage.

The tool of the present disclosure enables the application of an impression to a base material at a much earlier time in the curing process and on a much larger scale, to achieve a much better quality finished product than has been presently attainable with current methodology and tools. Applying the concrete impression at an earlier stage in the curing process, as well as using a larger stamp, allows a concrete finisher to be able to finish a larger area in a much shorter time, reducing labor costs and providing a better quality product. The tool is easily reusable, which cuts down significantly in the cost of concrete stamping, making it more affordable and desirable for consumers.

The various embodiments described above can be combined to provide further embodiments. For example, the designs shown and described herein are merely representative designs. Other design patterns can be used, such as a random rock design. Also, it may be possible, but not preferred, to form the tool from aluminum or a shape memory alloy, although this is quite costly.

Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A tool for forming impressions in concrete material, comprising:

a single-piece, molded, shaped, framework of cured flexible material consisting of polyurethane or polyuria in a shape of a pattern, the cured material having a memory property configured to return to an original state such that the framework is capable of being folded multiple times or rolled, and then unfolded or unrolled to return to the original state without distorting the shape of the pattern, the framework configured to be pressed into the base material to leave an impression in the concrete in the shape of the pattern.

2. The tool of claim 1, wherein the material has a shore hardness of 95.

3. The tool of claim 2, wherein each segment of the framework has a first side shaped to form an impression in the concrete, and an opposing side comprising a planar surface.

4. The tool of claim 3, wherein each segment has a cross-sectional configuration that is one of either a triangle, truncated triangle, or hemispherical.

5. A system, comprising:

concrete; and a tool, the tool comprising a single-piece shaped, flexible framework consisting of cured molded polyurethane or polyuria material having integrally formed segments in the shape of a repeatable pattern, the cured material having a memory property to retain and return to an original state such that the framework can be folded multiple times or rolled, and then unfolded or unrolled to return to the original state without distorting the shape of the pattern, the framework configured to be pressed into the concrete before it is dry to leave an impression in the concrete in the shape of the repeatable pattern and to be removed in one piece before the concrete hardens.

6. The system of claim 5, wherein the cured material has a shore hardness of 95.

7. The system of claim 6, wherein each segment of the framework has a first side shaped to form an impression in the concrete, and an opposing side comprising a planar surface.

8. The system of claim 7, wherein each segment has a cross-sectional configuration that is one of either a triangle, truncated triangle, or hemispherical.

9. A method for stamping a concrete, comprising:

deploying a tool from a stored configuration to a deployed configuration, the tool having a shaped, flexible framework consisting of cured polyurethane or polyuria material with integrally formed segments in the shape of a pattern, the cured material having a memory property configured to retain and return the framework to an original state that is the deployed configuration such that the framework can be folded multiple times or rolled into the stored configuration and then unfolded or unrolled to return to the deployed configuration without distorting the shape of the pattern, the framework configured to be pressed into the concrete while the concrete is wet to leave an impression in the concrete in the shape of the pattern and to be removed in one piece for repeated use;

impressing the tool into the concrete while the concrete is wet using a roller; and removing the tool without separating the segments to leave grout lines in the concrete in the shape of the pattern before the concrete hardens and to leave the tool intact for repeated use.

10. The method of claim 9, comprising treating the tool with a release agent prior to impressing the tool in the base material.

11. The method of claim 9, comprising applying a textured mat over the tool and impressing the mat into the concrete with pressure to provide a texture to segments between the grout lines.

12. The method of claim 9, comprising preparing the concrete prior to impressing the tool by allowing the wet concrete to partially cure until it can support the weight of the tool.

13. The method of claim 12, comprising preparing the wet concrete before allowing it to partially cure by tamping the wet concrete and floating the tamped wet concrete.

14. The method of claim 13, comprising trowling the tool after impressing the tool into the concrete to smooth out any marks left by the impressing.

15. The method of claim 14 comprising folding or rolling the tool into the stored configuration after the removing of the tool from the concrete.

* * * * *